US012185798B2

(12) United States Patent
Altepeter

(10) Patent No.: US 12,185,798 B2
(45) Date of Patent: Jan. 7, 2025

(54) LANYARD FOB

(71) Applicant: Steven Altepeter, East Grand Forks, MN (US)

(72) Inventor: Steven Altepeter, East Grand Forks, MN (US)

( * ) Notice: Subject to any disclaimer, the term of this patent is extended or adjusted under 35 U.S.C. 154(b) by 169 days.

(21) Appl. No.: 18/099,889

(22) Filed: Jan. 20, 2023

(65) Prior Publication Data

US 2023/0240414 A1 Aug. 3, 2023

Related U.S. Application Data

(60) Provisional application No. 63/304,219, filed on Jan. 28, 2022.

(51) Int. Cl.
*A44B 15/00* (2006.01)
*A45F 5/00* (2006.01)

(52) U.S. Cl.
CPC ..... *A44B 15/005* (2013.01); *A45F 5/00* (2013.01); *A45F 2005/006* (2013.01); *A45F 2200/0558* (2013.01)

(58) Field of Classification Search
CPC ..... A44B 15/005; A44B 15/00; A44B 15/002; A45F 5/00; A45F 5/02; A45F 2005/006; A45F 2200/0558; A45C 13/023; A47G 29/10; E05B 19/0005; E05B 19/0082; E05B 67/00; E05B 67/003; E05B 73/0005
See application file for complete search history.

(56) References Cited

U.S. PATENT DOCUMENTS 3,908,418 A * 9/1975 Stoffel ..... A44B 15/00 70/456 R
4,091,646 A * 5/1978 Sugimoto ..... A44B 15/00 70/459
4,314,467 A * 2/1982 Arvan ..... A44B 15/005 70/456 R
4,358,944 A * 11/1982 Stoffel ..... A44B 15/00 70/457
10,574,284 B1 * 2/2020 Winston ..... A45F 5/00
2007/0278265 A1 * 12/2007 Contente ..... A45F 5/02 224/604
2023/0034203 A1 * 2/2023 Buss ..... G07C 9/26

* cited by examiner

*Primary Examiner* — Christine M Mills
*Assistant Examiner* — Yahya Sidky
(74) *Attorney, Agent, or Firm* — My Patent Guys; Christopher Pilling

(57) ABSTRACT

A lanyard fob having a fob and a lanyard. The fob having a front housing and a rear housing, wherein the front housing is configured to rotate about the rear housing, wherein the rear housing includes a first pocket and a second pocket. The lanyard having a first end and a second end, wherein the first pocket is configured to receive the first end and the second pocket is configured to receive the second end. The first end is permanently fixed within the first pocket and second end is configured to removably slide within the second pocket such that the lanyard fob is operable between an open position and closed position.

6 Claims, 3 Drawing Sheets

OPEN POSITION

OPEN POSITION

CLOSED POSITION

LANYARD FOB

CROSS-REFERENCE TO RELATED APPLICATIONS

This application claims priority to U.S. Provisional Application No. 63/304,219 filed Jan. 28, 2022, which is hereby incorporated in its entirety at least by reference.

BACKGROUND OF THE INVENTION

1. Field of the Invention

The present invention relates generally to key rings but more particularly to a lanyard fob.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a lanyard fob is provided, comprising a fob having a front housing and a rear housing, wherein the front housing is configured to rotate about the rear housing, wherein the rear housing includes a first pocket and a second pocket; a lanyard having a first end and a second end, wherein the first pocket is configured to receive the first end and the second pocket is configured to receive the second end; and, wherein the first end is permanently fixed within the first pocket and the second end is configured to removably slide within the second pocket such that the lanyard fob is operable between an open position and closed position.

In one embodiment, the lanyard is rigid and flexible. In one embodiment, a power button configured to activate a LED bulb flashlight is provided. In one embodiment, the first end and the second end of the lanyard is comprised of a bulbous shape and the first pocket and the second pocket have a corresponding bulbous shape to receive the bulbous shape of the first end and the second end. In one embodiment, the rear housing includes a circular track which enables the rotation of the front housing about the rear housing. In another embodiment, the circular track includes grooves configured to provide stop points along the circular track to control the rotation between the front housing and the rear housing. In one embodiment, the front housing is configured to rotate about the rear housing up to a predetermine angle of 45 degrees.

In another aspect of the invention, a method of securing keys or elements to a lanyard fob is provided, comprising steps (a) providing the lanyard fob, wherein the lanyard fob comprises a fob having a front housing and a rear housing, wherein the rear housing includes a first pocket and a second pocket, and a lanyard having a first end and a second end, wherein the first pocket is configured to receive the first end and the second pocket is configured to receive the second end; (b) rotating the front housing about the rear housing such that the second pocket is exposed; (c) positioning the lanyard fob to an open position such that the second end of the lanyard is free and not engaged with the second pocket; (d) threading on the keys or elements onto the second end of the lanyard; (e) positioning the second end of the lanyard into the second pocket; and, (f) rotating the front housing about the rear housing such that the second pocket is in a closed position.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1A:
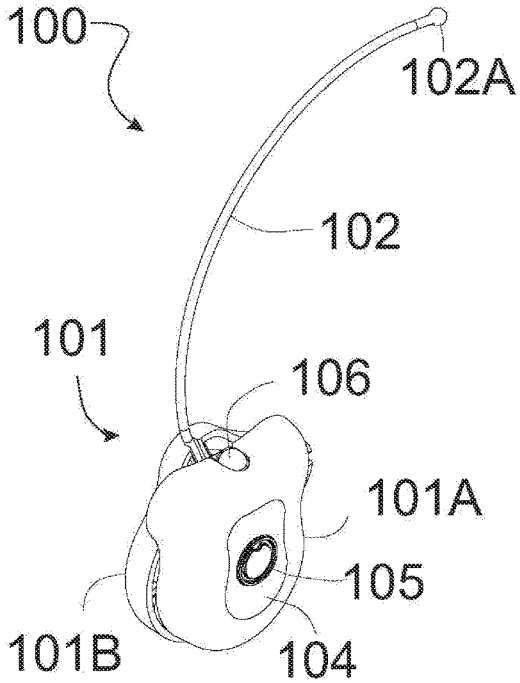
FIG. 1A is a front perspective view of a lanyard fob in an opened position according to an embodiment of the present invention.
Figure 1B:
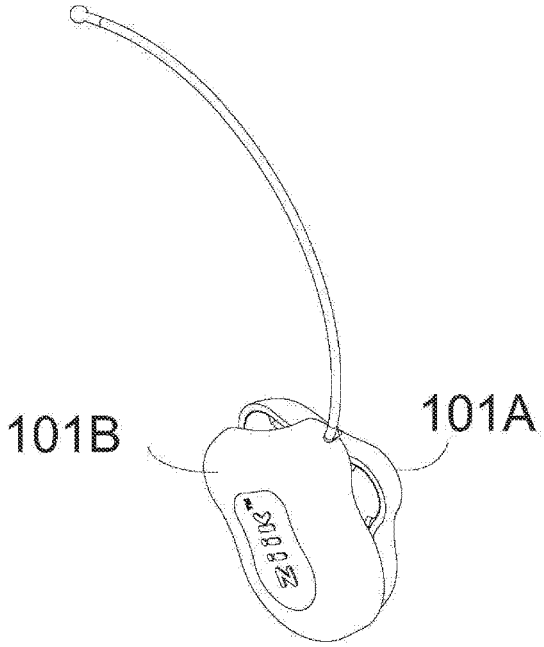
FIG. 1B is a rear perspective view of the lanyard fob in an opened position according to an embodiment of the present invention.
Figure 1C:
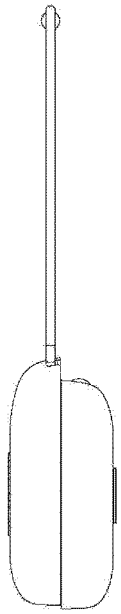
FIG. 1C is a side view of the lanyard fob in an opened position according to an embodiment of the present invention.
Figure 1D:
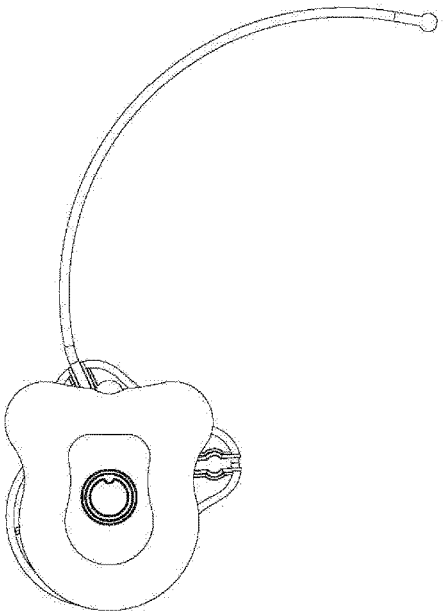
FIG. 1D is a front view of the lanyard fob in an opened position according to an embodiment of the present invention.
Figure 1E:
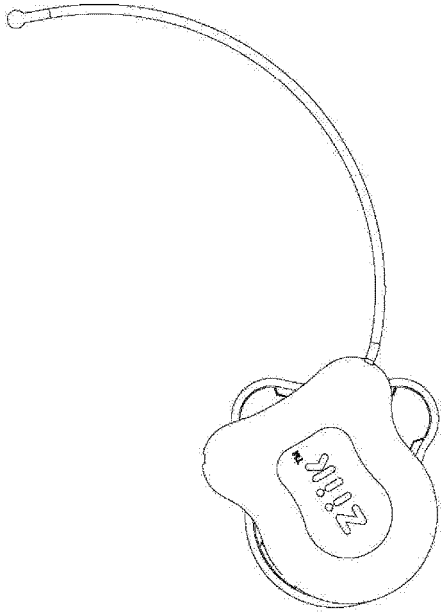
FIG. 1E is a rear view of the lanyard fob in an opened position according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a lanyard fob.

FIGS. 1A-E show various views of a lanyard fob in an opened position according to an embodiment of the present invention. Referring now to FIGS. 1A-E, the lanyard fob 100 is illustrated. In one embodiment, the lanyard fob comprises fob 101 and lanyard 102. In one embodiment, the fob 101 is comprised of a front housing 101A and a rear housing 101B in rotational engagement, wherein the front housing 101A and the rear housing 101B are configured to rotate up to a predetermined angle in relation to each other. In one embodiment, the predetermined angle is visible in FIGS. 1A-E, i.e. the full rotational range of motion is shown. In one embodiment, the predetermined angle is approximately 45 degrees, however, it should be understood that the predetermined angle may vary. This will be discussed in greater detail below.

In one embodiment, an electronic housing 104 is provided and attached to the front housing 101A, wherein the electronic housing 104 includes a power button 105 configured to activate a LED bulb 106. Advantageously, the LED bulb acts as a flashlight and provides visibility when using the lanyard fob. In other embodiments, the electronic housing can provide other electronic components, including but not limited to, GPS tracking, wireless charging, an accelerometer, or other electronic tools. In some embodiments, the electronic housing may be part of the front housing, such that fob 101 is comprised of two parts. In some embodiments, the electronic housing is positioned within the front housing. In another embodiment, the electronic housing is a separate independent housing attached to either the front or rear housing. In yet another embodiment, the electronic components are within the front or rear housing and there is not a separate electronic housing. For example, the electronic components may be enclosed or protected within the front or rear housing.

Figure 2A:
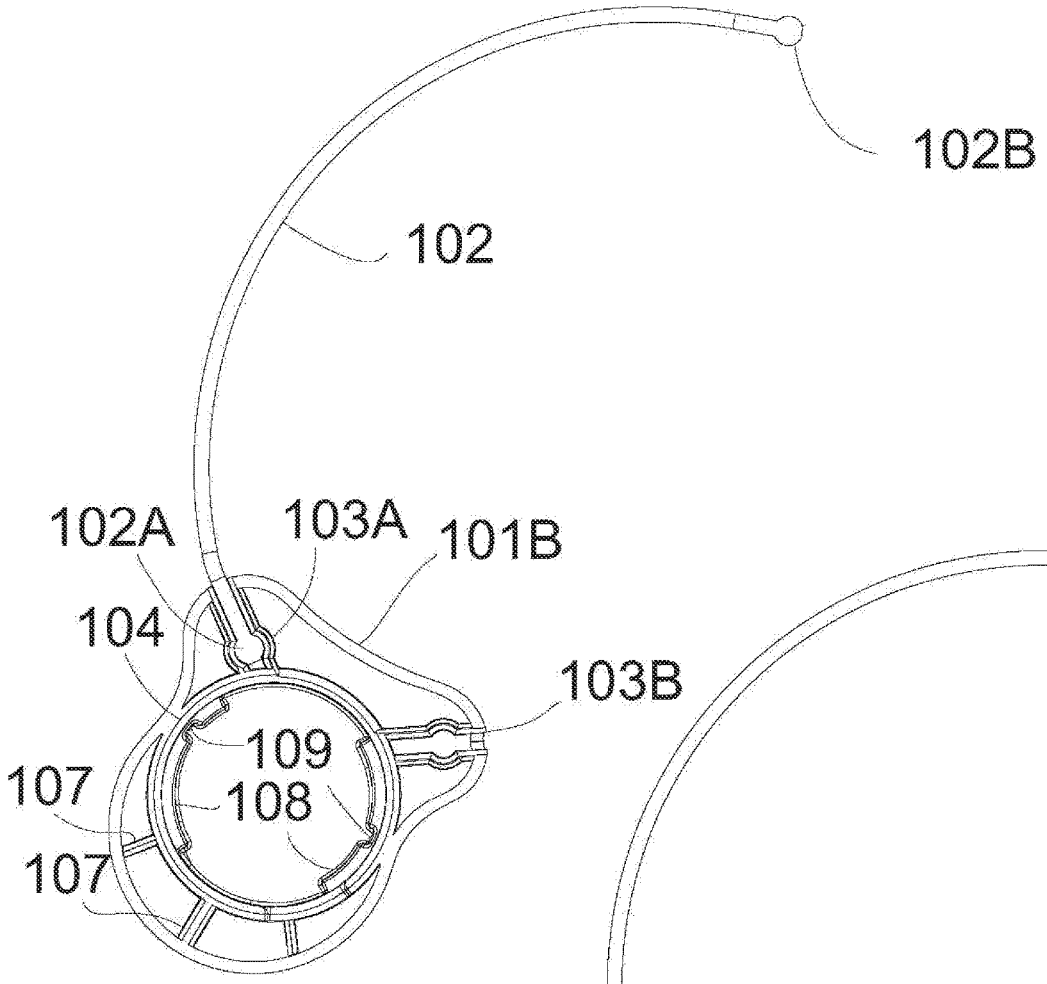
FIG. 2A is a front view of the lanyard fob in an opened position with the front housing of the fob removed.
Figure 2B:
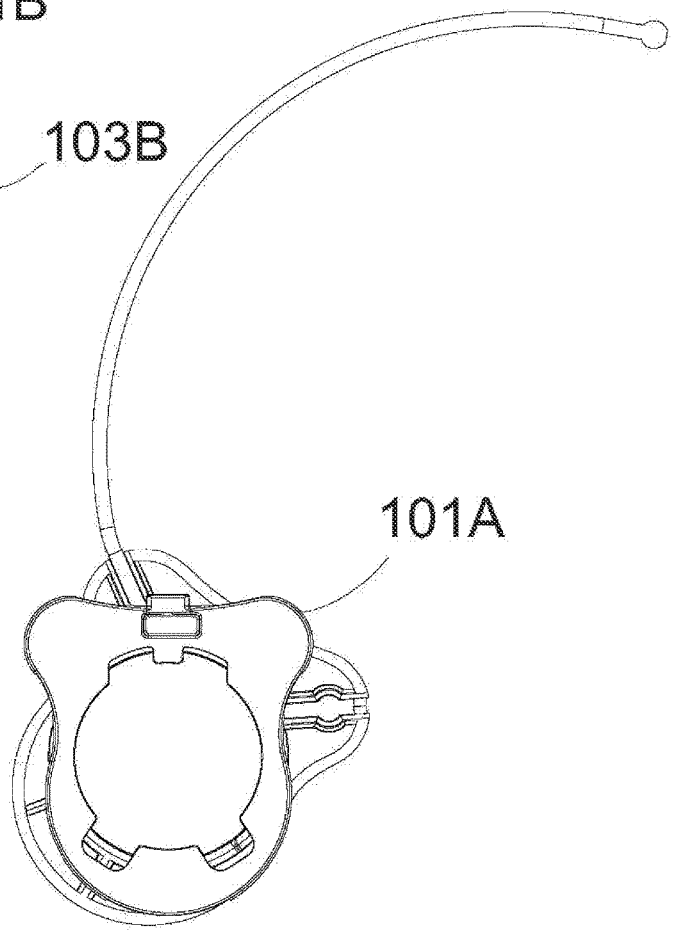
FIG. 2B is a front view of FIG. 2A with the front housing of the fob installed and shown in the opened position with the electronic housing removed.

FIG. 2A is a front view of the lanyard fob in an opened position with the front housing of the fob removed. Referring now to FIG. 2A, the internal structure of the rear housing 101B of the fob is visible. In one embodiment, the rear housing 101B includes a first pocket 103A and a second pocket 103B, wherein each pocket is located in opposing top ends (ears) of the top portion of the front housing 101B. In one embodiment, the lanyard 102 includes a first end 102A and a second end 102B, wherein the first pocket 103A is configured to receive the first end 102A and the second pocket 103B is configured to receive the second end 102B. In one embodiment, the first end 102A is permanently fixed within the first pocket 103A, via adhesives or mechanical fastening method, such as a press fit or screws. The second end 102B is configured to removably slide within the second pocket 103B. In some embodiments, the lanyard ends are comprised of a bulbous shape and the pockets have a corresponding shape to receive the bulbous shape ends. In one embodiment, the lanyard is rigid, as it is intended to hold keys or similar items often placed on a key ring or keychain, yet flexible enough to be manipulated by a user to move the second end 102B of the lanyard from the opened position to the closed position (FIGS. 3B-C).

In one embodiment, the fob is hollow with a plurality of structural elements 107 providing structural support to the shape and outer shell of the housing. Also visible is a curricular track 108 which enables the rotational action between the front housing 101A and the rear housing 101B. In some embodiments, grooves 109 may be provided for assisting installation between the front housing and the rear housing and/or to provide stop points along the track to control the rotation between housings. It should be understood, that other structural methods and elements may be used to control and determine the rotation and predetermined angle of the rotation. The predetermined angle should approximately be the minimum angle in which the front housing 101A may rotate in relation to the rear housing 101B such that the second pocket 103B is visible and easily accessible by a user, allowing the placement of the second end 102B of the lanyard to be positioned into the second pocket 103B. This minimum angle provides a more efficient operation than a large angle, for instance requiring less motion to operate the invention and reducing the probability of a mechanical defect.

Figure 3A:
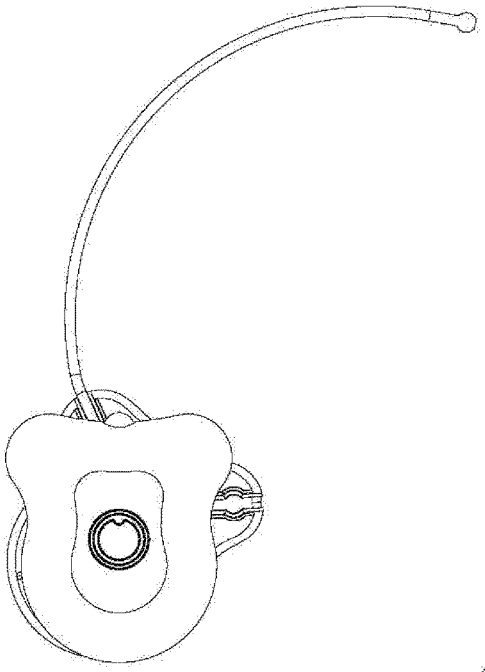
FIG. 3A is a front view of the lanyard fob in an opened position according to an embodiment of the present invention.
Figure 3B:
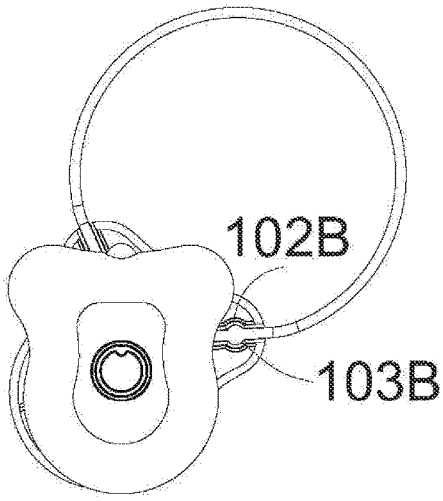
FIG. 3B is a front view of the lanyard fob in an opened position with the second end of the lanyard positioned into the second pocket of the rear housing according to an embodiment of the present invention.
Figure 3C:
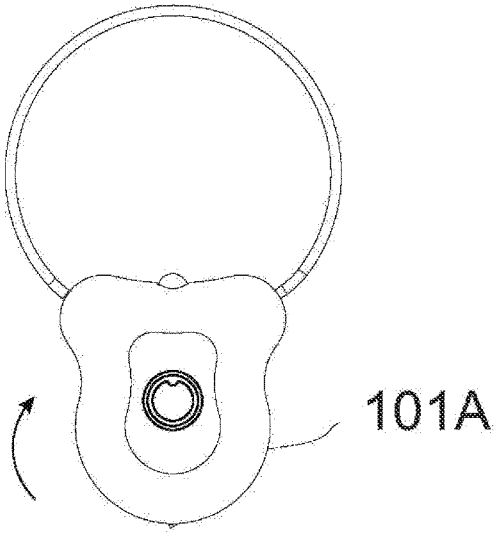
FIG. 3C is a front view of the lanyard fob in a closed position according to an embodiment of the present invention.

FIGS. 3A-C, show the steps to transition the lanyard fob from an opened position to a closed position. In FIG. 3A, the lanyard fob is in an opened position as previously discussed. In FIG. 3B, the second end 102B the lanyard is positioned into the second pocket 103B as previously discussed. Next, in FIG. 3C, the front housing 101A is rotated to a closed position such that the two housings (front and rear) of the fob are aligned and the pockets are not visible which locks the second end of the lanyard within the housings. Now, any keys or other elements are secured on the lanyard for use. The front housing 101A only needs to be rotated allowing the second end 102B of the lanyard to be removed from the second pocket 103 allowing the keys to be accessed, or to add keys or any additional elements on the lanyard. In storage it remains in a closed position.

It should be understood that the rotational locking mechanism is one option, and the front and rear housing of the fob may be slid or pulled apart from each other as an alternative. It has been determined, that the rotation locking mechanism as described herein is preferred, as it provides a quick release, but does not open by accident, such as while the device is carried in a pocket, bag, or purse. Further, the quick release locking mechanism described herein provides a distinct advantage over traditional key rings, as they are often frustrating to operate when adding or removing keys and other elements.

In one embodiment, the materials of the lanyard fob are plastic, wherein the fob is a rigid plastic and the lanyard is a rigid but flexible plastic. In some embodiments, the lanyard may include or be reinforced with steel wire or cable, or be entirely constructed from a stainless steel cable, or similar material. As the function of the invention has been described, it should be understood that the materials may vary or be altered to be selected for their characteristics as well known in the art.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For example, although in the embodiment described above one end of the lanyard is fixed within the pocket and the other is configured to be removably secured, in other embodiments, both ends of the lanyard may be removably secured. Likewise, the shape and structure of the lanyard ends may vary.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A lanyard fob comprising:

a fob having a front housing and a rear housing, wherein the front housing is configured to rotate about the rear housing, wherein the rear housing includes a first pocket and a second pocket;

a lanyard having a first end and a second end, wherein the first pocket is configured to receive the first end and the second pocket is configured to receive the second end; and, wherein the first end is permanently fixed within the first pocket and the second end is configured to removably slide within the second pocket such that the lanyard fob is operable between an open position and closed position wherein the rear housing includes a circular track which enables the rotation of the front housing about the rear housing, and the circular track includes grooves configured to provide stop points along the circular track to control the rotation between the front housing and the rear housing.

2. The lanyard fob of claim 1, wherein the lanyard is rigid and flexible.

3. The lanyard fob of claim 1, further comprising a power button configured to activate a LED bulb flashlight.

4. The lanyard fob of claim 1, wherein the first end and the second end of the lanyard is comprised of a bulbous shape and the first pocket and the second pocket have a corresponding bulbous shape to receive the bulbous shape of the first end and the second end.

5. The lanyard fob of claim 1, wherein the front housing is configured to rotate about the rear housing up to a predetermined angle of 45 degrees.

6. A method of securing keys or elements to a lanyard fob comprising steps:

(a) providing the lanyard fob, wherein the lanyard fob comprises a fob having a front housing and a rear housing, wherein the rear housing includes a first pocket and a second pocket, and a lanyard having a first end and a second end, wherein the first pocket is configured to receive the first end and the second pocket is configured to receive the second end, wherein the rear housing includes a circular track having grooves;

(b) rotating the front housing about the rear housing, via the circular track, such that the second pocket is exposed;

(c) positioning the lanyard fob to an open position such that the second end of the lanyard is free and not engaged with the second pocket;

(d) threading on the keys or elements onto the second end of the lanyard;

(e) positioning the second end of the lanyard into the second pocket; and, (f) rotating the front housing about the rear housing such that the second pocket is in a closed position; and wherein the grooves provide stop points along the circular track to control the rotation between the front housing and the rear housing.

* * * * *